US006350359B1

(12) United States Patent
Doebler et al.

(10) Patent No.: US 6,350,359 B1
(45) Date of Patent: Feb. 26, 2002

(54) PROCESS FOR COATING THREE-DIMENSIONAL ELECTRICALLY CONDUCTIVE SUBSTRATES

(75) Inventors: Klaus-Peter Doebler, Radevormwald; Klausjoerg Klein, Wuppertal, both of (DE)

(73) Assignee: E. I. du Pont de Nemors and Company, Wilmington, DE (US)

( * ) Notice: Subject to any disclaimer, the term of this patent is extended or adjusted under 35 U.S.C. 154(b) by 0 days.

(21) Appl. No.: 09/713,393

(22) Filed: Nov. 15, 2000

(51) Int. Cl.[7] ..... C25D 13/12
(52) U.S. Cl. ..... 204/488; 204/484; 204/479
(58) Field of Search ..... 204/479, 484, 204/488

(56) References Cited

U.S. PATENT DOCUMENTS 6,183,809 B1 * 2/2001 Sakuragi et al. ..... 204/471

FOREIGN PATENT DOCUMENTS

EP 0 982 413 A * 3/2000
JP 08170035 A * 7/1996

* cited by examiner

*Primary Examiner*—Kishor Mayekar
(74) *Attorney, Agent, or Firm*—Steven C. Benjamin

(57) ABSTRACT

A process for coating three-dimensional, electrically conductive substrates by applying a coating layer of a stoving coating composition substantially only to the exterior surfaces of the substrates at a layer thickness sufficient to electrically insulate such surfaces, stoving the coating layer and then coating the interior surfaces with an electrodeposition coating composition, wherein the stoving coating composition is characterised by a volume resistivity from $10^8$ to $10^{11}$ Ohm·cm of applied and stoved coating layers of said composition.

9 Claims, No Drawings

PROCESS FOR COATING THREE-DIMENSIONAL ELECTRICALLY CONDUCTIVE SUBSTRATES

FIELD OF THE INVENTION

The invention relates to a process for coating three-dimensional, electrically conductive substrates, and to the substrates coated accordingly.

BACKGROUND OF THE INVENTION

Present-day automotive coatings are prepared predominantly by applying an electrodeposition coating primer, a primer surfacer layer and a one-coat top coating or a two-coat top coating comprising a base coat and a clear coat layer.

In the past, a coating process which became known as the "reverse process" was used, wherein initially a primer surfacer layer was applied directly to the metallic outer skin of a motor vehicle body and stoved. Then, an electrodeposition coating primer was applied to the metal surfaces inside the body which had remained uncoated, and stoved. See G. Fetdis, Automotive paints and coatings, Verlag Chemie, Weinheim, 1995, pages 61–63. The motor vehicle bodies coated by the "reverse process" were characterised by an outstanding optical surface quality but had insufficient corrosion protection in the transition area between parts of the body surface coated with primer surfacer and with electrodeposition coating primer.

A process is known from EP-A-0 982 413 which is intended to overcome the disadvantages of the "reverse process" in that a plastics film is bonded to the exterior visible surfaces of a motor vehicle body and electrodeposition coating priming of the metallic surface not provided with plastics film subsequently takes place. The application of the plastics film to achieve an exact fit is complicated, labour-intensive and represents a source of trouble.

The object of the present invention is to avoid the above-mentioned weaknesses in corrosion protection of three-dimensional objects, particularly motor vehicle bodies, coated by the "reverse process" principle.

SUMMARY OF THE INVENTION

The invention provides a process for coating three-dimensional, electrically conductive substrates having interior and exterior surfaces; the process comprising (a) applying a coating layer of a stoving coating composition substantially only to the exterior surfaces of the substrate; (b) stoving the coating layer; and (c) applying an electrodeposition coating composition substantially only to the interior surfaces of the substrate, wherein the stoving coating composition is applied at a coating thickness sufficient to electrically insulate the exterior surfaces of the substrate and wherein the stoving coating composition is characterised by a volume resistivity from $10^8$ to $10^{11}$ Ohm·cm of applied and stoved coating layers of said composition.

DETAILED DESCRIPTION OF THE EMBODIMENTS

The references to thickness of a coating composition, such as by the phrases "layer thickness", "coating thickness" and the like means the dry film thickness of the layer or coating concerned.

In the process according to the invention, three-dimensional, electrically conductive substrates, particularly metal substrates such as motor vehicle bodies and motor vehicle body parts are coated. Examples of metals used in such substrates include galvanised or ungalvanised steel, aluminium and/or magnesium. The metals can be pretreated, for example phosphated and passivated and/or electrically conductive precoated. Composite substrates of such metals and, for example, plastics, are also suitable.

Initially, in the process according to the invention, a coating layer of a stoving coating composition is applied substantially only to the exterior surfaces of the three-dimensional substrates and stoved. The composition is applied at a sufficient thickness to ensure insufficient electrical conductivity for the deposition of an electrodeposition coating layer on the stoved coating layer. In other words, the stoving coating composition is applied at a thickness sufficient to electrically insulate the exterior surfaces of the substrate. The exterior surfaces include, for example, surfaces of a motor vehicle body which are directly visible to the observer from the outside of the vehicle, i.e., body panels, doors, hood, trunk lid, etc.

The stoving coating compositions may be waterborne stoving coating compositions to be applied by electrodeposition, for example, electro powder coatings. Preferably, however, they are waterborne, solvent-based or powder stoving coating compositions to be applied by spraying.

The stoving coating compositions contain conventional cross-linkable binders. These binders may be self cross-linking or may be cross-linked by the use of a separate cross-linking agent. Cross-linkable binder systems known to the skilled person and used in primer surfacer coating compositions are particularly suitable. Examples of binders are polyester, epoxy and polyurethane resins. Examples of cross-linking agents are aminoplastic resins such as melamine resins, benzoguanamine resins and blocked polyisocyanates. The solids weight ratio (parts by weight) between binders and cross-linking agents is preferably 60:40 to 90:10.

It is important for the invention to select the stoving coating compositions such that applied and stoved coating layers of said compositions have a volume resistivity from $10^8$ to $10^{11}$, preferably $10^{10}$ to $8\times10^{10}$ Ohm·cm. The volume resistivity may be measured by conventional methods known to the skilled person, as described for example in DIN IEC 93. In order to obtain the volume resistivity of $10^8$ to $10^{11}$ Ohm·cm, the stoving coating compositions preferably contain electrical conductive components. Examples of such components are particulate inorganic or organic electrical conductors or semi-conductors, such as, for example, black iron oxide, graphite, conductive carbon black, metal powder, e.g. of aluminium, zinc, copper or refined steel, molybdenum disulfide, in particular conductive pigments such as, for example, doped pearlescent pigments, for example, mica platelets provided with a thin layer of antimony-doped tin oxide, or conductive barium sulfate in which the particle core is coated with a thin layer of antimony-doped tin oxide. Electrically conductive polymers such as, e.g., polyaniline, are also suitable but less preferred. The electrically conductive components may be used alone or in combination. They may be introduced into the stoving coating compositions in the same way as conventional coating pigments or fillers. The amount of electrically conductive components needed in the stoving coating composition is, for example, from 1 to 30 wt. %, based on the solids content. The amount needed for any particular composition may be determined easily by the skilled person and is dependent upon, for example, the specific gravity, the specific electrical conductivity and the particle size of the electrically conductive components.

In addition to binders, cross-linking agents and the electrically conductive components and optionally water and/or organic solvents (for liquid compositions), the stoving coating compositions generally contain pigments and/or fillers. The amount of pigment and/or filler used is typically an amount sufficient to provide a pigment/filler to binder solids weight ratio of 0.1:1 to 2:1. When calculating the pigment/filler to binder solids weight ratio, the electrically conductive components are counted as pigment/filler and the weight of binders solids includes any cross-linking agents.

Examples of pigments and/or fillers used in addition to the electrically conductive components include conventional inorganic and/or organic colored pigments and/or fillers such as carbon black, titanium dioxide, iron oxide pigments, phthalocyanine pigments, quinacridone pigments, azo pigments, barium sulfate, calcium carbonate, kaolin, talc or silica.

Pigments, fillers as well as electrically conductive components may be introduced separately or in mixture into the stoving coating compositions. The nature of introduction is immaterial; the methods known to the skilled person for the preparation of coatings may be used, for example, the addition during the course of a preparation from scratch by way of appropriate pastes or by subsequent addition to an inherently finished stoving coating composition, for example, one ready for application. The particles are dispersed in each case or even ground.

The stoving coating compositions are applied in a layer thickness sufficient to electrically insulate the exterior surfaces of the substrate. This ensures that, in the subsequent process steps, the stoving coating composition is not overcoated with the electrodeposition layer. The layer thickness corresponds at least to the minimum layer thickness of, for example, 3 to 10 $\mu$m, providing sufficient electrical insulation, and the desired layer thickness of the stoving coating layer is preferably greater than the minimum layer thickness. For example, the desired layer thickness is 15 to 100 $\mu$m, preferably 25 to 80 $\mu$m. The stoving coating composition is preferably applied by spraying. After application of the stoving coating composition, the coating is stoved at temperatures from, for example 80 to 180° C.

In the process of the invention, the stoving coating composition is applied substantially only to the exterior surfaces of the three-dimensional substrates. It should be understood, however, that in practice other surfaces of the substrates also get coated to some extent in the application of the stoving coating composition such as, for example, from overspray. The coating of these other surfaces is, however, at a thickness substantially less than that required to electrically insulate the surface. A transition zone is therefore formed between surface parts of the three-dimensional substrates provided with the stoving coating layer and those to be provided with the electrodeposition coating composition.

In the transition zone, the thickness of the stoving coating layer decreases from the minimum layer thickness to 0 over the width of the transition zone. A coating with electrodeposition coating agent is possible below the minimum layer thickness of the stoving coating layer. An increasing layer thickness of an electrodeposition coating layer deposited on the stoving coating layer can be obtained starting from this minimum layer thickness down to smaller layer thicknesses of the stoving coating layer in the transition zone. In the above mentioned transition zone it is therefore possible to deposit an electrodeposition coating, the layer thickness of which depends on the layer thickness below the minimum thickness of the stoving coating layer.

The width of this transition zone typically varies between 0.2 and 20 cm and depends on various factors such as the structural features of the substrate and on the application conditions for the stoving coating composition. Examples of structural features include various types of openings in the exterior surface (such as for windows, sliding roof, or assembly openings in a motor vehicle body). Examples of application conditions include the handling of spray-coating devices, air flow conditions, spray application with or without electrostatic support.

After application and stoving of the stoving coating layer, the interior surfaces, including the transition zone, are coated in an electrodeposition coating bath in the conventional way known to the skilled person. Suitable electrodeposition coatings include conventional waterborne coating compositions with a solids content from, for example, 10 to 30 wt. %.

The electrodeposition coating compositions may be conventional anodic electrodeposition coating agents known to the skilled person. The binder basis of the anodic electrodeposition coating composition may be chosen at will. Examples of anodic electrodeposition binders are polyesters, epoxy resin esters, (meth)acrylic copolymer resins, maleinate oils or polybutadiene oils with a weight average molecular mass (Mw) of, for example, 300–10 000 and a carboxyl group content, for example, corresponding to an acid value of 35 to 300 mg KOH/g. At least a part of the carboxyl groups is converted to carboxylate groups by neutralisation with bases. These binders may be self cross-linking or cross-linked with separate cross-linking agents.

Preferably conventional cathodic electrodeposition coating agents known to the skilled person are used in the process according to the invention for the application of the electrodeposition coating layer. Cathodic electrodeposition coating compositions contain binders with cationic groups or groups which can be converted to cationic groups, for example, basic groups. Examples include amino, ammonium, e.g., quaternary ammonium, phosphonium and/or sulfonium groups. Nitrogen-containing basic groups are preferred; said groups may be present in the quaternised form or they are converted to cationic groups with a conventional neutralising agent, e.g., an organic monocarboxylic acid such as, e.g., formic acid, lactic acid, methane sulfonic acid or acetic acid. Examples of basic resins are those with primary, secondary and/or tertiary amino groups corresponding to an amine value from, for example 20 to 200 mg KOH/g. The weight average molecular mass (Mw) of the binders is preferably 300 to 10 000. Examples of such binders are amino(meth)acrylic resins, aminoepoxy resins, aminoepoxy resins with terminal double bonds, aminoepoxy resins with primary OH groups, aminopolyurethane resins, amino group-containing polybutadiene resins or modified epoxy resin-carbon dioxide-amine reaction products. These binders may be self-cross-linking or they may be used with known cross-linking agents in the mixture. Examples of such cross-linking agents include aminoplastic resins, blocked polyisocyanates, cross-linking agents with terminal double bonds, polyepoxy compounds or cross-linking agents containing groups capable of transesterification.

Apart from binders and any separate cross-linking agents, the electrodeposition coating compositions may contain pigments, fillers and/or conventional coating additives. Examples of suitable pigments include conventional inorganic and/or organic colored pigments and/or fillers, such as carbon black, titanium dioxide, iron oxide pigments, phthalocyanine pigments, quinacridone pigments, kaolin, talc or silicon dioxide. Examples of additives include, in particular, wetting agents, neutralising agents, levelling agents, catalysts, corrosion inhibitors, anti-cratering agents, anti-foaming agents, solvents.

Electrodeposition coating compositions which have good throwing power behaviour are preferred in the process according to the invention.

Electrodeposition coating takes place in a conventional manner known to the skilled person, for example, at deposition voltages from 200 to 500 V, preferably under application conditions which permit good throwing power, if possible. After deposition of the electrodeposition coating, the substrate is again stoved at object temperatures from, for example, 120 to 180° C.

It is not usually possible to deposit an electrodeposition coating layer onto interior surfaces of a three-dimensional substrate in a layer thickness which is the same everywhere. The application of the electrodeposition coating layer takes place in the process according to the invention in a layer thickness which ensures adequate corrosion protection on the interior surfaces of the three-dimensional substrates. For example, the electrodeposition coating layer thickness should be in a range from 3 to 40, preferably 5 to 15 μm.

The three-dimensional substrates coated according to the procedure of the invention have on their exterior surfaces a coating layer of a stoving coating composition whereas the interior surfaces are provided with an electrodeposition coating. Although the substrates in the process according to the invention are coated according to the "reverse process" principle, they exhibit good resistance to corrosion covering the entire surface which is not achieved in three-dimensional substrates coated according to the reverse process of the prior art.

The substrates coated with stoving coating layer and electrodeposition coating primer may be provided with one or more further coating layers, particularly on the exterior surfaces. Initially, an intermediate layer may be applied and optionally stoved before a top coating is applied. For motor vehicle applications, the intermediate layer is preferably not used. The top coating may be applied from a waterborne, solvent-based or powder top coat as a single-layer top coating which determines the color shade, or it is applied as a two-layer top coating in the conventional manner, preferably wet-in-wet from a waterborne, solvent-based or powder base coat which determines the color shade and/or special effect, and a waterborne, solvent-based or powder clear coat.

The process according to the invention is particularly suitable for motor vehicle coating. Motor vehicle bodies prepared therewith have not only good corrosion protection but also an outstanding optical surface quality (appearance, gloss) as a consequence of the primer of the stoving coating composition applied to their exterior surfaces. The stoving coating composition produces inherently smoother coatings versus conventional electrodeposition coating primer layers and thus offers a favourable basis for a smooth surface of the subsequent coating layers.

The examples below illustrate the effect of the process according to the invention on the basis of the model coating of test metal sheets with a stoving coating composition and a cathodic electrodeposition coating composition.

EXAMPLES

Example 1

One side of a test metal sheet 10 cm×30 cm in size made of zinc-phosphated body steel (Bonder 26 S 60 OC) was provided, by spraying, with a primer surfacer layer (stoving coating layer) covering a layer thickness zone from 30 to 0 μm and flowing in a wedge shape in the longitudinal direction of the test metal sheet (primer surfacer used: Herberts Aqua Fill R 63069.1 from DuPont Performance Coatings GmbH & Co. KG; solids content by weight: 47.4 wt. %, pigment/binder weight ratio 1:1) and stoved for 15 min at 160° C. (object temperature). The stoved primer surfacer layer had a volume resistivity of $1.3\times10^{11}$ Ohm·cm.

The test metal sheet coated on one side was then coated at a deposition voltage of 250 V for 3 minutes in a cathodic electrodeposition bath (Herberts Aqua EC 2000 R 39662.1 from DuPont Performance Coatings GmbH & Co. KG, adjusted to a solids content of 18 wt. %) at 30° C. and then stoved for 15 min at 175° C. (object temperature).

The cathodic electrodeposition coating layer thickness on the portions of the test metal sheet surface not coated with primer surfacer was 20 μm. Deposition of the cathodic electrodeposition coating had taken place on the primer surfacer wedge as from a primer surfacer layer thickness of less than 1.5 μm.

Example 2

5 parts by weight of Minatec® 40 CM (mica coated with antimony-doped tin oxide) from Merck were added to 95 parts by weight of primer surfacer (Herberts Aqua Fill R 63069.1 from DuPont Performance Coatings GmbH & Co. KG; see Example 1) and ground for 30 minutes in a pearl mill.

Example 3

Example 1 was repeated in similar manner but the modified primer surfacer from example 2 was used instead of the primer surfacer used in example 1. The stoved primer surfacer layer had a volume resistivity of $6.5\times10^{10}$ Ohm·cm. The deposition of the cathodic electrodeposition coating on the primer surfacer wedge had taken place as from a primer surfacer layer thickness of less than 7 μm.

The coated test metal sheets obtained in example 1 and 3 underwent a corrosion test involving a 240 hour salt spray loading (DIN 53167 without cut). Table 1 and Table 2 summarise layer thicknesses of the primer surfacer wedge and of the cathodic electrodeposition layer, and the results of the corrosion test (evaluation according to DIN 53209 with regard to amount m and size g of rust blisters) corresponding to the coating from example 1 and the coating from example 3 respectively.

TABLE 1

| Layer thickness of primer surfacer wedge (μm) | Cathodic electrodeposition coating layer thickness (μm) | Result of the corrosion test (m/g) |
|---|---|---|
| 30 | 0 | 0/0 |
| 10 | 0 | 0/0 |
| 5 | 0 | 4/3 |
| 2 | 0 | 4/5 |
| 1 | 15 | 0/0 |
| 0 | 20 | 0/0 |

TABLE 2

| Layer thickness of primer surfacer wedge ($\mu$m) | Cathodic electrodeposition coating layer thickness ($\mu$m) | Result of the corrosion test (m/g) |
|---|---|---|
| 30 | 0 | 0/0 |
| 10 | 0 | 0/0 |
| 5 | 8 | 0/0 |
| 2 | 9 | 0/0 |
| 1 | 15 | 0/0 |
| 0 | 20 | 0/0 |

What is claimed is:

1. A process for coating three-dimensional, electrically conductive substrates having interior and exterior surfaces, said process comprising:

(a) applying a stoving coating composition substantially only to the exterior surfaces of the substrate;

(b) stoving the coating layer; and (c) coating the interior surfaces of the substrate with an electrodeposition coating composition;

wherein the stoving coating composition is applied at a thickness sufficient to electrically insulate the exterior surfaces of the substrate and wherein the stoving composition is characterised by a volume resistivity from $10^8$ to $10^{11}$ Ohm·cm of applied and stoved coating layers of said composition.

2. The process of claim 1, wherein the stoving coating composition is characterised by a volume resistivity from $10^{10}$ to $8\times10^{10}$ Ohm·cm of applied and stoved coating layer of said composition.

3. The process of claim 1, wherein the stoving coating composition is applied by spraying and is selected from the group consisting of waterborne, solvent-based and powder stoving coating compositions.

4. The process of claim 1, wherein the stoving coating composition contains electrically conductive components.

5. The process of claim 4, wherein the electrically conductive components are present in an amount of 1 to 30 wt. %, based on the solid content of the stoving coating composition.

6. The process of claim 1, wherein the stoving coating layer is applied in a layer thickness from 15 to 100 $\mu$m.

7. The process of claim 1, wherein the electrodeposition coating composition used is a cathodic electrodeposition coating composition.

8. The process of claim 1, further comprising the step of applying at least one additional coating layer.

9. The process of claim 1, wherein the substrates are selected from the group consisting of motor vehicle bodies and motor vehicle body parts.

* * * * *